US006723908B2

(12) United States Patent
Chapman et al.

(10) Patent No.: US 6,723,908 B2
(45) Date of Patent: Apr. 20, 2004

(54) PICK GUARD WITH ELECTRONIC CONTROL HOUSING AND INTERFACE FOR ACOUSTIC GUITAR

(75) Inventors: Keith Lance Chapman, Fountain Hills, AZ (US); Charles Clifford Adams, Gilbert, AZ (US); Shawn Robert Greene, Higley, AZ (US)

(73) Assignee: Fender Musical Instruments Corporation, Scottsdale, AZ (US)

( * ) Notice: Subject to any disclaimer, the term of this patent is extended or adjusted under 35 U.S.C. 154(b) by 0 days.

(21) Appl. No.: 10/188,540

(22) Filed: Jul. 3, 2002

(65) Prior Publication Data

US 2004/0003703 A1 Jan. 8, 2004

(51) Int. Cl.[7] ..... G10G 5/00
(52) U.S. Cl. ..... 84/453; 84/291
(58) Field of Search ..... 84/290–291, 320, 84/453

(56) References Cited

U.S. PATENT DOCUMENTS 4,261,240 A * 4/1981 Aaroe ..... 84/739
5,517,891 A 5/1996 Sica
5,549,026 A 8/1996 Gay, Jr.
5,637,823 A 6/1997 Dodge
5,949,006 A * 9/1999 Hechler ..... 84/291
6,103,961 A * 8/2000 Kaufman ..... 84/291
6,114,616 A 9/2000 Naylor
6,191,350 B1 2/2001 Okulov et al.

OTHER PUBLICATIONS

R.G.A.P. Innovation [online]; Jun. 27, 2002; Retrieved from the Internet: http://www.gsignature.com.

* cited by examiner

*Primary Examiner*—Marlon T. Fletcher
(74) *Attorney, Agent, or Firm*—Robert D. Atkins; Charles & Brady Stretch Lang LLP

(57) ABSTRACT

A musical string instrument (12) has a body (21) with a resonate cavity covered by a soundboard (22). A pick guard (34) has a flat surface for mounting to the soundboard of the instrument. Electronic control components (36) are mounted within a housing of the pick guard. The musician can control a preamplifier within the resonate cavity of the body with knobs (58) and push buttons (60) located on the pick guard. A thin, flat, multi-conductor ribbon cable (38) is connected to the electronic control components and routed along a surface of the soundboard and through a sound hole (24) in the soundboard into the resonate cavity of the body. The ribbon cable entering the resonating cavity through the sound hole does not adversely effect the natural response, performance, sound quality, and tonal property of the string instrument and does not require any additional holes be drilled in the soundboard.

29 Claims, 3 Drawing Sheets

PICK GUARD WITH ELECTRONIC CONTROL HOUSING AND INTERFACE FOR ACOUSTIC GUITAR

FIELD OF THE INVENTION

The present invention relates in general to musical instruments and, more particularly, to a protective guard for a string instrument with electronic controls.

BACKGROUND OF THE INVENTION

Musical instruments have always been very popular in society providing entertainment, social interaction, self-expression, and a business and source of livelihood for many people. String instruments are especially popular because of their active playability, tonal properties, and portability. String instruments are fun and yet challenging to play, have great sound qualities, and are easy to move about from one location to another.

Guitars are one type of string musical instrument. The musical artist or user plays the guitar by using their fingers or a guitar pick to displace one or more of the tightly strung strings from their neutral position and then releasing causing the string to vibrate as it returns to its neutral position. The pick offers certain advantages in terms of sharpness of the string vibration and clarity of the note played. Using a pick also reduces the wear and tear and discomfort on the fingers.

Unfortunately, guitar picks have the potential for scratching or marring the surface and finish of the guitar face or soundboard. The opportunity to damage the guitar with a pick is even greater for playing styles that involve the artist moving their pick hand relative to the guitar face or soundboard, e.g. while strumming the guitar, or when the artist is otherwise aggressively playing the instrument. The pick can easily slide off the strings and strike the guitar face or soundboard causing damage.

Some guitars have a pick guard mounted below the strings to protect the face or soundboard. If the pick slides off the strings, it merely strikes the pick guard which is made of a resilient material such as plastic. The pick causes little or no damage to the pick guard and in any event the pick guard can be easily and cost effectively replaced if necessary.

Many guitars include electronic preamplifiers which are designed to interface to an external power amplifier to amplify and enhance the sound of the instrument. For certain types of guitars, such as electric guitars, the pick guard is a convenient place to locate the electronic controls for the preamplifier. The preamplifier controls may include one or more rotating knobs, switches, and other push buttons. Wiring or cables must be routed from the controls on the pick guard to the cavity of the guitar where the electronic preamplifier is located. For an electric guitar, holes are routinely drilled in the face to route the wiring from the pick guard controls to the electronic preamplifier. The wiring holes in the face of an electric guitar have minimal adverse impact on the tonal properties because they are solid body instruments and much of the tone originates from the electronics and mass of the guitar body.

Acoustic guitars present a different problem. The soundboard of an acoustic guitar is a principal source of the sound coming from the instrument. Any device mounted on or mass added to the soundboard or holes drilled in the soundboard can adversely effect its natural response, performance, and tonal properties.

It is known in the prior art to mount a pick guard to an acoustic guitar to protect the surface and finish of the soundboard as noted above. Pick guards for acoustic guitars are typically cantilevered to avoid adding mass and to minimize contact and interference with the soundboard. Cantilever-mounted pick guards make it difficult to provide for strong, effective bracing. In addition, cantilever-mounted pick guards are suitable only for styles of play such as jazz where the hand does not leave the guitar and therefore do not work well when strumming the instrument.

Acoustic guitars are also known to have electronic preamplifiers. Any preamplifier controls, such as a volume control, are typically mounted to the top side of the body so as to avoid drilling holes in the soundboard and hindering its performance. The electronic controls in the top side of the body can be inconvenient to access and adjust while playing the instrument.

SUMMARY OF THE INVENTION

In one embodiment, the present invention is a musical instrument comprising a body having a resonate cavity covered by a soundboard. The soundboard has a sound hole across which a plurality of strings of the musical instrument are strung. A pick guard has a flat surface mounted to the soundboard. Electronic control components are mounted within a housing of the pick guard. A ribbon cable is coupled to the electronic control components and routed along a surface of the soundboard and through the sound hole into the resonate cavity of the body. The ribbon cable entering the resonating cavity through the sound hole does not adversely effect the natural response, performance, sound quality, and tonal properties of the string instrument and does not require any additional holes be drilled in the soundboard.

In an alternative embodiment, the present invention is a pick guard for a musical instrument comprising a first surface which is substantially flat and adapted for mounting to the musical instrument. A second surface has a flat striking region and a raised region integral with and ramping up from the flat striking region. A housing is formed in the raised region. An electronic control component is mounted within the housing.

In yet another embodiment, the present invention is a method of protecting a surface of a musical instrument comprising the steps of mounting a protective guard having a flat surface flush to a soundboard, mounting an electronic control component within a housing of the protective guard, connecting a cable to the electronic control component, and routing the cable along a surface of the soundboard and around a lip of an opening in the soundboard into a resonate cavity of the musical instrument.

DETAILED DESCRIPTION OF THE DRAWINGS

Figure 1:
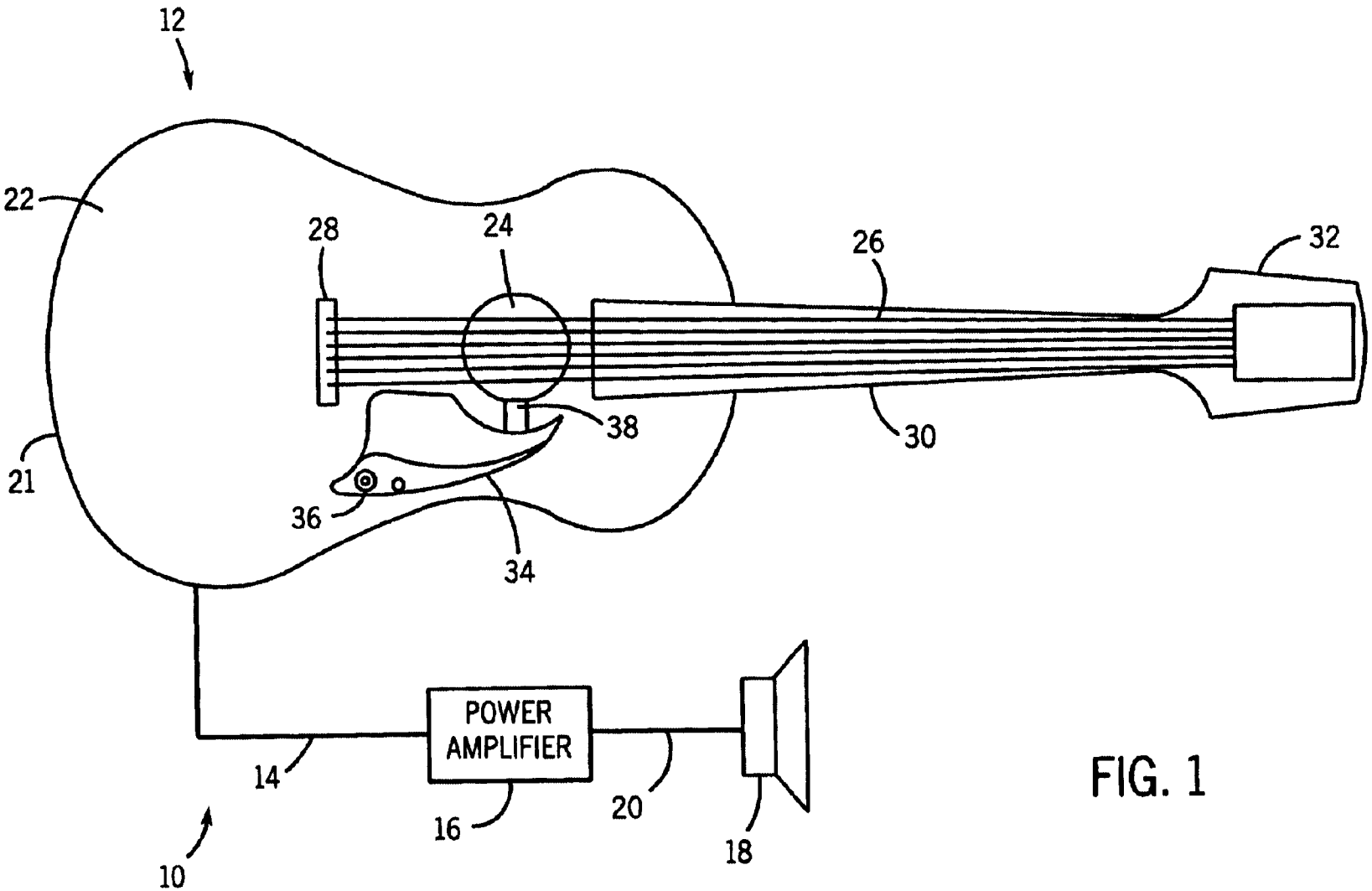
FIG. 1 illustrates a guitar with mounted pick guard and on-board pre-amplifier driving a power amplifier and loudspeaker.

Referring to FIG. 1, a musical sound system 10 is shown. Musical sound system 10 includes a string instrument having a resonating cavity such as guitar, bass, mandolin, and violin. The string instrument in FIG. 1 is an acoustic guitar 12. A musician or artist plays guitar 12 to generate musical sounds as a variety of notes and chords which emanate directly from the instrument soundboard. The musical sounds from guitar 12 are also routed as an audio electrical signal through audio grade shielded wire 14 from an on-board pre-amplifier to power amplifier 16, or possibly to a recording device. Power amplifier 16 and the on-board pre-amplifier may include manual and digital controls to select the sound amplification, equalization, filtering, special effects, and other signal processing of the audio signal. A loudspeaker 18 is coupled by speaker wire 20 to an output of power amplifier 16 to reproduce the amplified and enhanced audio signal.

The acoustic guitar is well known for its unique resonance and tonal properties, which is attributable to its design and construction. The acoustic guitar is popular for several styles of music including classical, country western, rock, blues, and jazz. Guitar 12 includes a body 21 having a resonating cavity covered by soundboard 22. The action and vibration of strings 26 causes a resonating sound within the resonating cavity which vibrates soundboard 22. An important feature of the acoustic guitar is the solid, one-piece construction of the soundboard. Soundboard 22 is a wood product such as rosewood, cedar, ebony, spruce, mahogany, and maple, with a sound hole cut-out or circular opening 24 cut in the face. The diameter of sound hole 24 determines in part the resonant frequency of guitar 12. A plurality of strings 26, normally six in number for most guitars, are tightly strung from bridge 28 over sound hole 24 and along fret board 30 to neck 32. Neck 32 includes tuning pegs to adjust the tension of strings 26.

A pick guard or protective guard 34 made of plastic or other polymer material is mounted flush to soundboard 22. Alternatively, pick guard 34 can be made from woods, light metals, rubber, or other synthetic or composite materials. Pick guard 34 is lightweight and thinly constructed to reduce mass and includes an adhesive backing for mounting to soundboard 22. The backing may be glue, bond paper, or other adhesive compound or material providing a strong, secure union between pick guard 34 and soundboard 22. Other types of fasteners, such as Velcro, tape, or small screws, can be used to mount pick guard 34 to soundboard 22.

The amount of contact area between the back surface of pick guard 34 and soundboard 22 depends on the application. In some applications, substantially all of the back side of pick guard 34 is covered with adhesive backing and intended to make contact with soundboard 22. In other applications, only select areas of the back side of pick guard 34 are covered with adhesive backing in order to reduce the contact area with soundboard 22. Less surface contact area may require stronger adhesive compound or material to maintain a strong, secure union between pick guard 34 and soundboard 22. Pick guard 34 is mounted to soundboard 22 without drilling holes through the soundboard. The combination with the lightweight material and thin construction of pick guard 34 and the lack of any additional holes through the soundboard avoids any adverse effect to the natural response, performance, and tonal properties of soundboard 22.

Pick guard 34 includes electronic control components 36 located in a housing integral to the molded construction of the pick guard. Electronic control components 36 include mechanical knobs, push buttons, rubber keypads, passive devices, potentiometers, electrical contacts, printed circuit board (PCB), and other electronic components for providing an electrical control function. Ribbon cable 38 is thin, flat, flexible multi-conductor cable with individually isolated wires connecting electronic control components 36 to an electronic preamplifier and an interface circuit (not shown) mounted within the resonating cavity of guitar 12. The output of the preamplifier and interface circuit is coupled by wire 14 to drive power amplifier 16 and loudspeaker 18.

Figure 2:
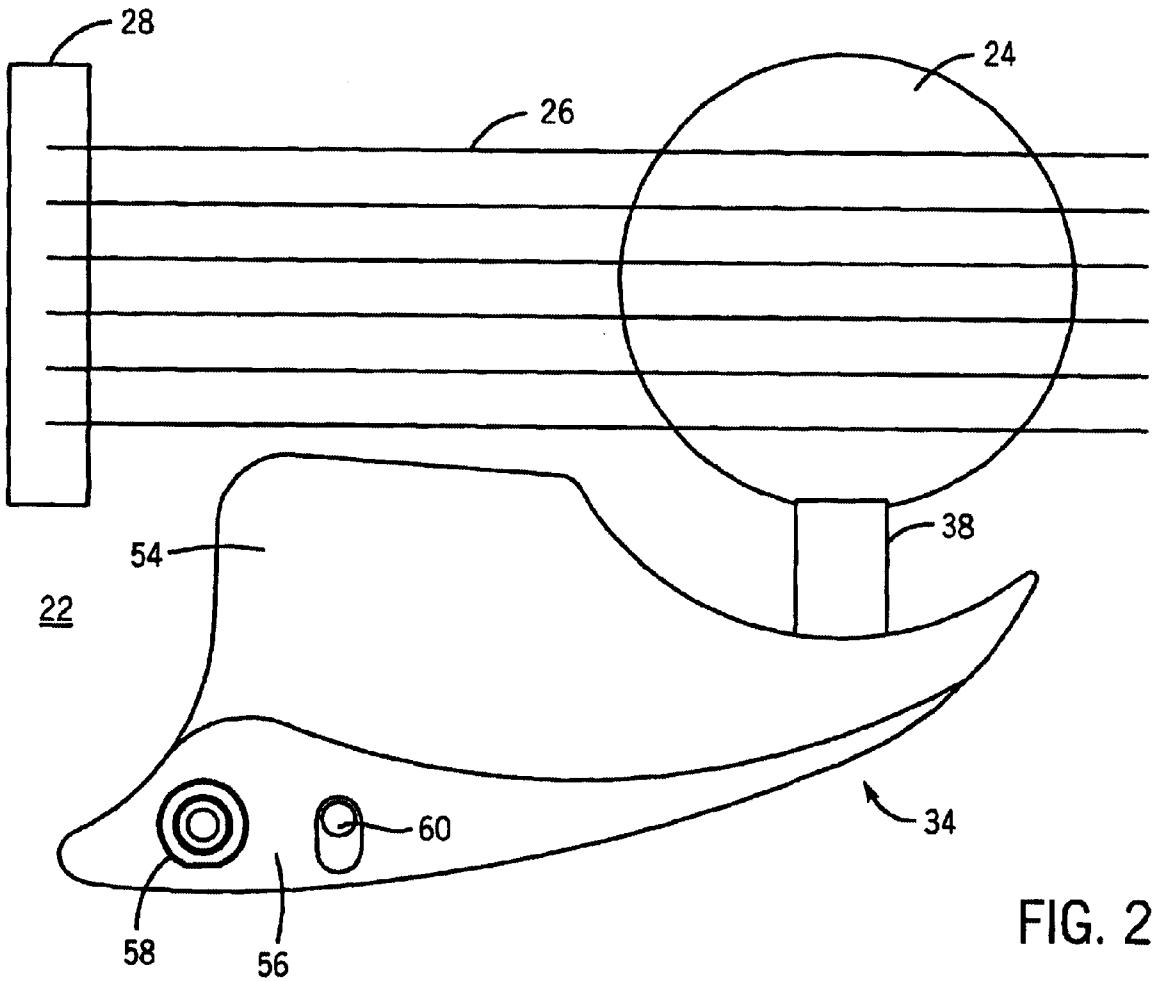
FIG. 2 illustrates further detail of the pick guard mounted to the guitar.

Turning to FIG. 2, further detail of pick guard 34 and a portion of soundboard 22 and sound hole 24 is shown. Pick guard 34 protects the material and finish of soundboard 22 from the action of a pick (not shown) when playing guitar 12. The guitarist holds the pick between their fingers. As the guitarist moves the pick in an upward and downward direction across strings 26, the pick strikes pick guard 34 instead of striking soundboard 22, which would otherwise scratch, mar, and damage the material and finish on soundboard 22. The pick has little if any effect on pick guard 34. After extended usage, pick guard 34 is simple and cost effective to replace.

Pick guard 34 is a one-piece molded plastic unit. Striking region 54 of pick guard 34 is relatively thin and flat with a thickness of about 1.8 millimeters (mm). Raised region 56 is an integral part of the same molded construction of pick guard 34 as striking region 54. Raised region 56 ramps up from flat striking region 54 to a maximum thickness of 11.7 mm to provide room to house electronic control components 36.

Electronic control components 36 extend through the top surface of raised region 56 for easy access by the guitarist or user. A mechanical knob 58 and a push button 60 are shown in FIG. 2. Mechanical knob 58 could be a volume control. Push button 60 engages a control function or special effect such as tone, parameter editing, parameter selection, or muting. Mechanical knob 58 and push button 60 provide easy and convenient access for the guitarist or user to control the electronic preamplifier and interface circuit. Electronic control components 36 may also control power amplifier 16 and loudspeaker 18. The guitarist need only move their hand down to electronic controls 36 mounted to raised region 56 at any break in the music or during play to adjust volume, engage one or more special effects, and otherwise control the signal processing of the audio signal. Pick guard 34 may have additional mechanical knobs, push buttons, key pads, rocker switches, other types of switches, slider potentiometers, encoders, thumb wheels, and other control components. Pick guard 34 may also include digital readouts, display devices, light emitting diodes, liquid crystal displays, and other forms of indicators or panel lighting to let the guitarist know the status and settings of the electronic preamplifier, interface circuit, power amplifier, and loudspeaker.

The signal conductors of ribbon cable 38 provide the necessary electrical connection between electronic control components 36 and the electronic preamplifier and interface circuit. Ribbon cable 38 is a thin flexible circuit film with individual electrically isolated wires or signal conductors that run from electronic control components 36 through channels in raised region 56 and striking region 54, or underneath pick guard 34, and along the contour or surface of soundboard 22. Ribbon cable 38 enters the resonating cavity of guitar 12 through sound hole 24 at its minimum arc point. The thin, flat, flexible construction of ribbon cable 38 allows it to follow the surface contour of soundboard 22 and bend around the lip or a perimeter section of sound hole 24. Ribbon cable 38 then follows the back side of soundboard 22 where it is routed along the structural ribs within the resonating cavity to the electronic preamplifier and interface circuit.

A feature of pick guard 34 is that it avoids the need to drill holes in soundboard 22 for any electrical wires. Instead, ribbon cable 38 provides the electrical connection between electronic control components 36 and the electronic preamplifier and interface circuit by entering the resonating cavity of guitar 12 through sound hole 24. The use of a thin, flat, flexible ribbon cable wrapped round the existing sound hole 24 allows access and connection of the electrical signal conductors from the pick guard electronic control components to the electronic preamplifier and interface circuit. The ribbon cable entering the resonating cavity through sound hole 24 does not adversely effect the natural response, performance, sound quality, and tonal properties of guitar 12 and does not require any additional holes be drilled in soundboard 22 for electrical wiring.

The back side of pick guard 34 is relatively flat to mount flush to soundboard 22. The top surface of striking region 54 and raised region 56 is a smooth or textured surface intended to be repeatedly struck with a pick without significant or noticeable damage, scratching, or marring. The guitarist may strum strings 26 or otherwise move their pick hand freely with respect to guitar 12. If the guitar pick slides off strings 26, then the pick strikes pick guard 34 instead of soundboard 22. The shape, form, and material of pick guard 34 protects the material and finish and prevents cosmetic damage to soundboard 22.

The shape and form of pick guard 34 shown in FIG. 2 is one ergonomically design for player comfort and utility. Other designs and patterns of pick guard 34 are contemplated and available that provide the protective feature, electronic control, and ergonomically design, while adding to the aesthetics of the guitar.

Figure 3:
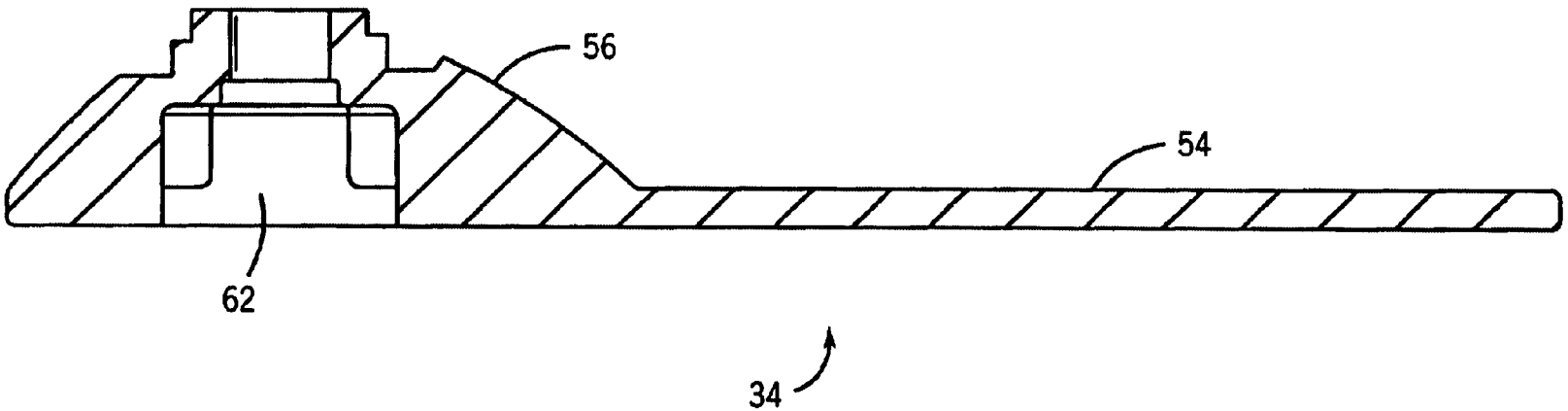
FIG. 3 is a cross sectional view of the pick guard.

A cross sectional view of pick guard 34 is shown in FIG. 3. The back side of pick guard 34 is relatively flat for mounting flush to soundboard 22. Alternatively, the back side of pick guard 34 may include raised or thicker areas intended to reduce the total contact area with soundboard 22. Raised region 56 includes a cavity or housing 62 for electronic control components 36. Mechanical knob 58 would be attached to a potentiometer located within housing 62. The potentiometer is mounted flush to the bottom of housing 62. Push button 60 would be a rubber keypad button and contact points for the signal conductors also located within housing 62. Electronic control components 36 may also include a PCB for mounting contact points for the potentiometer and push button and for other electronic components within housing 62.

Housing 62 is pressure fit molded and formed according to the control mechanism to be placed there to provide a tight fit and reduce component vibration. For example, the potentiometer geometry can be digitally modeled in three dimensions using advanced computer aided design techniques. The 3-D geometry is subtracted from the 3-D digitally designed pick guard piece within specified tolerances. In a similar manner, the rubber keypad button geometry is 3-D modeled and subtracted from the pick guard model to allow a near pressure fit. The PCB is likewise modeled in 3-D and subtracted from the underside of the pick guard under the raised plastic housing. Pick guard 34 completely encases electronic control components 36 aside from the exposed human interface controls such as mechanical knob 58 and push button 60 which may extend above the surface of the pick guard.

In production assembly, the potentiometer, rubber keypad, and PCB are inserted from the bottom of pick guard 34 and held in place by the combination of the near pressure fit and bushing and nut assembly, clips, or other retainers. Pick guard 34 may include a removable covering so that electronic control components 36 can be installed, serviced, and replaced from the top of the pick guard. The contact leads for the push button are printed on the PCB such that when the push button is pressed, it completes the trace circuit on the circuit board. The PCB is attached to the pick guard by counter sunk screws, thereby adding strength and rigidity to the assembly. The leads of the potentiometer are soldered to the PCB which then connects to ribbon cable 38 that runs through channels or underneath pick guard 34. The PCB could be a flex circuit material for mounting the control components and traces directly onto a Mylar sheet. Also, the pick guard itself could be all one piece PCB with a cosmetic covering layer.

In summary, a musical string instrument, such as an acoustic guitar, has a body having a resonate cavity covered by a soundboard. The soundboard has a sound hole across which a plurality of strings of the musical instrument are strung. A pick guard having a flat surface is mounted to the soundboard. Electronic control components are mounted within a housing of the pick guard. A ribbon cable is coupled to the electronic control components and routed along a surface of the soundboard and through the sound hole into the resonate cavity of the body. The ribbon cable entering the resonating cavity through the sound hole does not adversely effect the natural response, performance, sound quality, and tonal property of the string instrument and does not require any additional holes be drilled in the soundboard.

Although the present invention has been described with respect to preferred embodiment(s), any person skilled in the art will recognize that changes may be made in form and detail, and equivalents may be substituted for elements of the invention without departing from the spirit and scope of the invention. Therefore, it is intended that the invention not be limited to the particular embodiments disclosed for carrying out this invention, but will include all embodiments falling within the scope of the appended claims.

What is claimed is:

1. A musical instrument, comprising:

a body including a resonate cavity covered by a soundboard, the soundboard having an opening across which a plurality of strings of the musical instrument are strung;

a pick guard having a surface mounted to the body;

a housing formed within the pick guard;

an electronic component mounted within the housing of the pick guard; and a cable coupled to the electronic component and routed alone a surface of the soundboard and through the opening in the soundboard across which the plurality of strings are strung into the resonate cavity of the body.

2. The musical instrument of claim 1, wherein the pick guard includes:

a striking region; and a raised region integral with and ramping up from the striking region to form the housing.

3. The musical instrument of claim 2, wherein the pick guard includes a knob mounted to the raised region.

4. The musical instrument of claim 1, wherein the pick guard includes a push button disposed within the housing.

5. The musical instrument of claim 1, wherein the pick guard includes a printed circuit board disposed within the housing.

6. The musical instrument of claim 1, wherein the electronic component includes a potentiometer.

7. The musical instrument of claim 1, wherein the cable includes a multi-conductor ribbon cable coupled to the electronic component.

8. The musical instrument of claim 7, wherein the multi-conductor ribbon cable is mounted flush to the soundboard and bent around a lip of the opening of the soundboard to enter the resonate cavity of the body.

9. The musical instrument of claim 1, wherein the musical instrument is an acoustic guitar.

10. An acoustic guitar, comprising:

a body including a resonate cavity covered by a soundboard;

a pick guard having a first surface mounted to the body and a second surface, wherein a portion of the second surface is offset from the first surface to form a cavity between the first and second surfaces of the pick guard; and an electronic component mounted inside the cavity of the pick guard.

11. The acoustic guitar of claim 10, further including:

an opening in the soundboard cross which a plurality of strings of the acoustic guitar are strung; and a cable coupled to the electronic component and routed along a surface of the soundboard and through the opening in the soundboard into the resonate cavity of the body.

12. The acoustic guitar of claim 11, wherein the pick guard includes:

a striking region; and a raised region integral with and ramping up from the striking region to form the cavity of the pick guard.

13. The acoustic guitar of claim 12, wherein the pick guard includes a knob mounted to the raised region.

14. The acoustic guitar of claim 10, wherein the cable includes a multi-conductor ribbon cable coupled to the electronic component and mounted flush to the soundboard and bent around a lip of the opening of the soundboard to enter the resonate cavity of the body.

15. A pick guard for a musical instrument having a surface with a sound hole into a resonate cavity, the pick guard comprising:

a first surface adapted for mounting to the musical instrument;

a second surface having a striking region and a raised region integral with and ramping up from the striking region;

a housing formed between the first surface and the raised region of the second surface; and an electronic component mounted within the housing.

16. The pick guard of claim 15, further including a ribbon cable coupled to the electronic component and adapted for routing along the surface of the musical instrument through the sound hole and into the resonate cavity of the musical instrument.

17. The pick guard of claim 15, wherein the pick guard includes a knob mounted to the raised region.

18. The pick guard of claim 15, wherein the pick guard includes a push button disposed within the housing.

19. The pick guard of claim 15, wherein the pick guard includes a printed circuit board disposed within the housing.

20. The pick guard of claim 15, wherein the electronic component includes a potentiometer.

21. An apparatus, comprising:

a body having a resonate cavity and an opening into the resonate cavity;

a protective guard having a surface mounted to the body;

a housing formed within the protective guard;

an electronic component mounted within the housing of the protective guard; and a conductor coupled to the electronic component and routed along a surface of the body and through the opening into the resonate cavity of the body.

22. The apparatus of claim 21, wherein the protective guard includes:

a striking region; and a raised region ramping up from the striking region to form the housing.

23. The apparatus of claim 22, wherein the protective guard includes a knob mounted to the raised region.

24. The apparatus of claim 21, wherein the conductor includes a multi-conductor ribbon cable coupled to the electronic component and mounted flush to the surface of the body and bent around a lip of the opening to enter the resonate cavity of the body.

25. A method of protecting a surface of a musical instrument, comprising:

mounting a protective guard having a surface to a soundboard;

providing a housing within the protective guard;

mounting an electronic component within the housing of the protective guard;

connecting a cable to the electronic component; and routing the cable along a surface of the soundboard and around a lip of an opening in the soundboard into a resonate cavity of the musical instrument.

26. The method of claim 25 further including the steps of:

providing a striking region on the protective guard; and providing a raised region integral with and ramping up from the striking region to form the housing of the protective guard.

27. The method of claim 26 further including providing a knob mounted to the raised region.

28. The method of claim 25, wherein the cable includes a multi-conductor ribbon cable coupled to the electronic component.

29. The method of claim 25, wherein the musical instrument is an acoustic guitar.

* * * * *